US007942001B2

(12) United States Patent
Radcliff et al.

(10) Patent No.: US 7,942,001 B2
(45) Date of Patent: May 17, 2011

(54) CASCADED ORGANIC RANKINE CYCLES FOR WASTE HEAT UTILIZATION

(75) Inventors: Thomas D. Radcliff, Vernon, CT (US); Bruce P. Biederman, West Hartford, CT (US); Joost J. Brasz, Fayetteville, NY (US)

(73) Assignee: UTC Power, LLC, South Windsor, CT (US)

( * ) Notice: Subject to any disclaimer, the term of this patent is extended or adjusted under 35 U.S.C. 154(b) by 828 days.

(21) Appl. No.: 11/886,281

(22) PCT Filed: Mar. 29, 2005

(86) PCT No.: PCT/US2005/010738

§ 371 (c)(1),
(2), (4) Date: Sep. 13, 2007

(87) PCT Pub. No.: WO2006/104490

PCT Pub. Date: Oct. 5, 2006

(65) Prior Publication Data

US 2008/0168772 A1 Jul. 17, 2008

(51) Int. Cl.
*F01K 25/08* (2006.01)

(52) U.S. Cl. ..... 60/651; 60/653; 60/655; 60/671

(58) Field of Classification Search ..... 60/653, 60/677–680, 651, 655, 671
See application file for complete search history.

(56) References Cited

U.S. PATENT DOCUMENTS

| | | | | |
|---|---|---|---|---|
| 3,234,734 | A * | 2/1966 | Buss et al. | 60/651 |
| 3,393,515 | A | 7/1968 | Tabor et al. | |
| 3,908,381 | A * | 9/1975 | Barber et al. | 60/641.4 |
| 4,760,705 | A * | 8/1988 | Yogev et al. | 60/651 |
| 4,996,846 | A | 3/1991 | Bronicki | |
| 5,570,579 | A | 11/1996 | Larjola | |
| 6,052,997 | A | 4/2000 | Rosenblatt | |
| 6,571,548 | B1 | 6/2003 | Bronicki et al. | |
| 6,857,268 | B2 | 2/2005 | Stinger et al. | |
| 6,960,839 | B2 * | 11/2005 | Zimron et al. | 290/2 |
| 2005/0166607 | A1 * | 8/2005 | Brasz et al. | 62/114 |

FOREIGN PATENT DOCUMENTS

| | | |
|---|---|---|
| DE | 10355782 | 6/2005 |
| FR | 903448 | 10/1945 |
| WO | 9806791 | 2/1998 |
| WO | 2005108749 | 11/2005 |

* cited by examiner

*Primary Examiner* — Hoang M Nguyen
(74) *Attorney, Agent, or Firm* — Marjama Muldoon Blasiak & Sullivan LLP

(57) ABSTRACT

A pair of organic Rankine cycle systems (20, 25) are combined and their respective organic working fluids are chosen such that the organic working fluid of the first organic Rankine cycle is condensed at a condensation temperature that is well above the boiling point of the organic working fluid of the second organic Rankine style system, and a single common heat exchanger (23) is used for both the condenser of the first organic Rankine cycle system and the evaporator of the second organic Rankine cycle system. A preferred organic working fluid of the first system is toluene and that of the second organic working fluid is R245fa.

15 Claims, 5 Drawing Sheets

CASCADED ORGANIC RANKINE CYCLES FOR WASTE HEAT UTILIZATION

STATEMENT OF GOVERNMENT INTEREST

The United States Government has certain rights in this invention pursuant to Contract No. DE-FC02-00CH11060 between the Department of Energy and United Technologies Corporation.

BACKGROUND OF THE INVENTION

Power generation systems that provide low cost energy with minimum environmental impact, and that can be readily integrated into the existing power grids or rapidly sited as stand-alone units, can help solve critical power needs in many areas. Combustion engines such as microturbines or reciprocating engines can generate electricity at low cost with efficiencies of 25% to 40% using commonly available fuels such as gasoline, natural gas and diesel fuel. However, atmospheric emissions such as nitrogen oxides (NOx) and particulates can be a problem with reciprocating engines.

One method to generate electricity from the waste heat of a combustion engine without increasing the output of emissions is to apply a bottoming cycle. Bottoming cycles use waste heat from such an engine and convert that thermal energy into electricity. Rankine cycles are often applied as the bottoming cycle for combustion engines. A fundamental organic Rankine cycle consists of a turbogenerator, a preheater/boiler, a condenser, and a liquid pump. Such a cycle can accept waste heat at temperatures somewhat above the boiling point of the organic working fluid chosen, and typically rejects heat to the ambient air or water at a temperature somewhat below the boiling point of the organic working fluid chosen. The choice of working fluid determines the temperature range/thermal efficiency characteristics of the cycle.

Simple ORC Systems using one fluid are efficient and cost effective when transferring low temperature waste heat sources into electrical power, using hardware and working fluids similar to those used in the air conditioning/refrigeration industry. Examples are ORC systems using radial turbines derived from existing centrifugal compressors and working fluids such as refrigerant R245fa.

For higher temperature waste heat streams, the most cost-effective ORC systems still operate at relatively low working fluid temperatures, allowing the continued use of HVAC derived equipment and common refrigerant. However these systems, although very cost-effective, do not take full advantage of the thermodynamic potential of the waste heat stream.

SUMMARY OF THE INVENTION

Briefly, in accordance with one aspect of the invention, a pair of organic Rankine cycle (ORC) systems are combined, and a single common heat exchanger is used as both the condenser for the first ORC system and as the evaporator for the second ORC system.

By another aspect of the invention, the refrigerants of the two systems are chosen such that the condensation temperature of the first, higher temperature, system is a useable temperature for boiling the refrigerant of the second, lower temperature, system. In this way, greater efficiencies may be obtained and the waste heat loss to the atmosphere is substantially reduced.

In accordance with another aspect of the invention, the single common heat exchanger is used to both desuperheat and condense the working fluid of the first ORC system.

By another aspect of the invention, if a second heat exchanger is provided in the first ORC system, with the common heat exchanger acting to desuperheat the working fluid of the first ORC system, and the second condenser acting to condense the working fluid in the first ORC system.

By yet another aspect of the invention, a preheater, using waste heat, is provided to preheat the working fluid in the second ORC system prior to its entry into the common heat exchanger.

In the drawings as hereinafter described, preferred and modified embodiments are depicted; however various other modifications and alternate constructions can be made thereto without departing from the true spirit and scope of the invention.

DESCRIPTION OF THE PREFERRED EMBODIMENT

Figure 1:
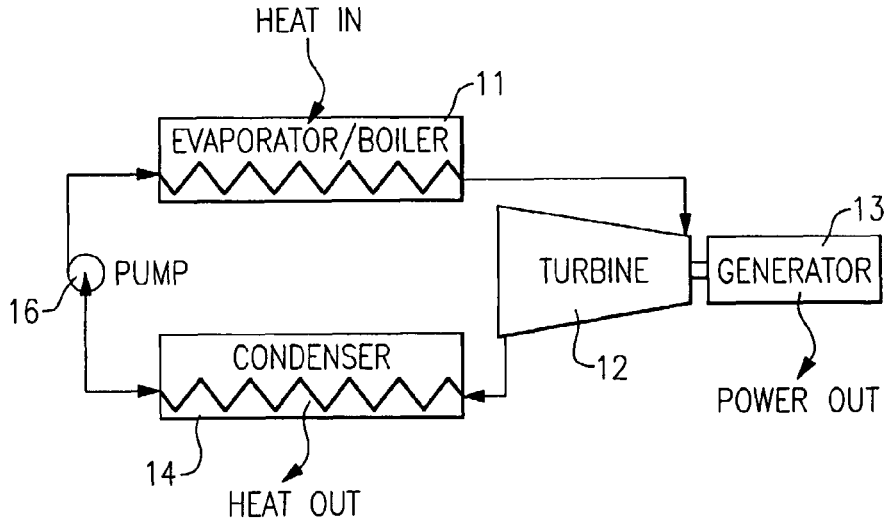
FIG.1 Prior Art
FIG. 1 is a schematic illustration of an organic Rankine cycle system in accordance with the prior art.

Referring now to FIG. 1, a conventional type of organic Rankine cycle system is shown to include an evaporator/boiler 11 which receives waste heat from a source as described hereinabove. The heated working fluid passes to the turbine 12, where it is converted to motive power to drive a generator 13. The resulting lower temperature and pressure working fluid then passes to a condenser 14 where it is converted to a liquid, which is then pumped by the pump 16 back to the evaporator/boiler 11.

In such a typical system, a common working fluid is toluene. In the vapor generator 11 the working fluid has its temperature raised to around 525° F. after which it is passed to the turbine 12. After passing through the turbine 12, the temperature of the vapor drops down to about 300° F. before it is condensed and then pumped back to the evaporator/boiler 11.

Figure 2:
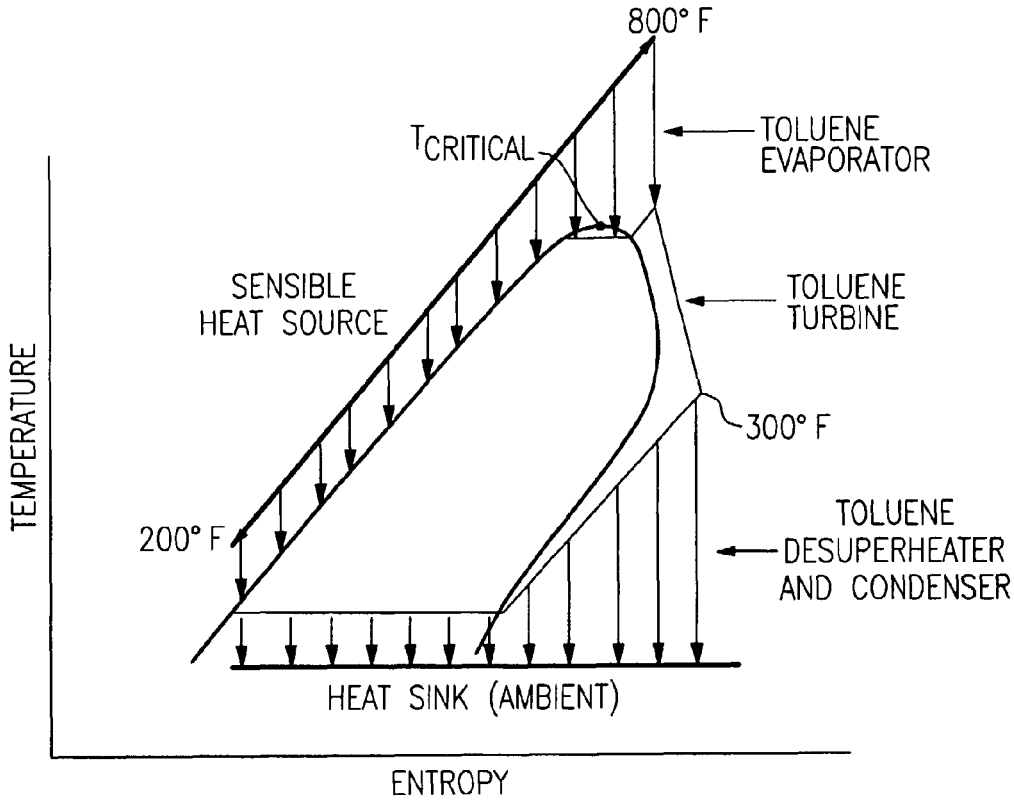
FIG.2 Prior Art
FIG. 2 is a TS diagram thereof.

Shown in FIG. 2 is a TS diagram of the organic rankine cycle system illustrated in FIG. 1, using toluene as the working fluid. As will be seen, because of the relatively high critical temperature, the toluene is thermodynamically more efficient than systems with working fluids having lower critical temperatures. However, it is less cost effective and still leaves much to be desired in terms of efficiency. The reason for the higher cost of these higher temperature ORC systems is twofold: First, working fluids such as toluene, with high critical temperatures, allow operation at a higher evaporation temperature, which is relatively good for efficiency, but exhibit a very low density at ambient conditions, thus requiring large and expensive condensation equipment. Secondly, the nature of such high critical temperature organic fluids is that the higher the turbine pressure ratio (typically larger than 25:1 in such a system), the more superheated the vapor that leaves the turbine. The thermal energy represented by the superheat of the vapor leaving the turbine is therefore not used for power generation and requires additional condenser surface for rejection to ambient. Accordingly, there is a substantial amount of lower temperature waste heat (i.e. the heat of the superheated low pressure vapor leaving the turbine) which is not converted into power, thereby limiting the turbine efficiency.

Figure 3:
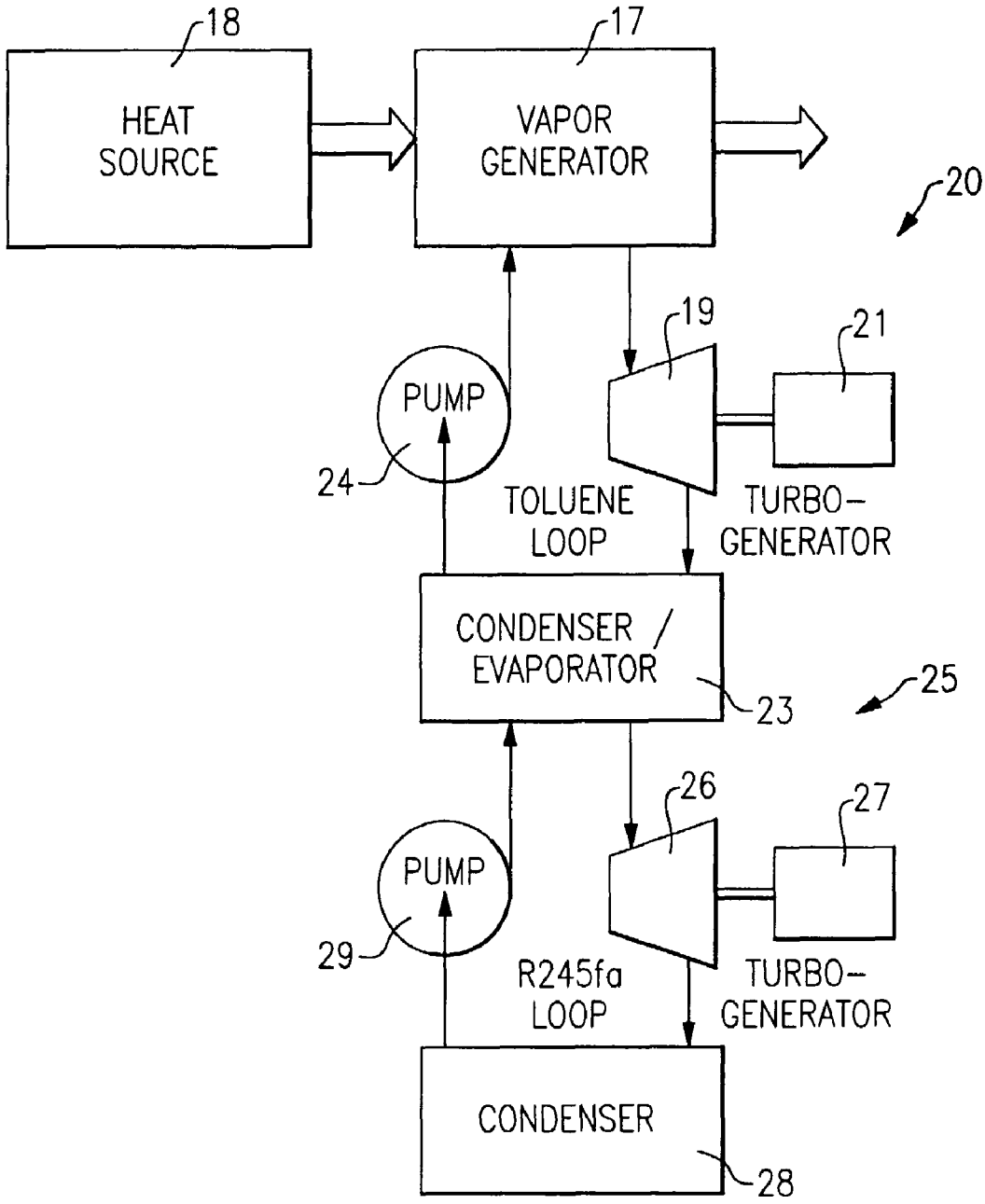
FIG. 3 is a schematic illustration of a pair of organic Rankine cycle systems as combined in accordance with the present invention.

Referring now to FIG. 3, a modified arrangement is shown to include a pair of organic Rankine cycle systems 20 and 25 that are combined in a manner which will now be described. An evaporator boiler or vapor generator 17 receives heat from a heat source 18 to produce relatively high pressure high temperature vapor which is passed to a turbine 19 to drive a generator 21. After passing through the turbine 19, the lower pressure, lower temperature vapor passes to the condenser/evaporator 23 where it is condensed into a liquid which is then pumped by the pump 24 to the vapor generator 17 to again be vaporized.

Figure 4:
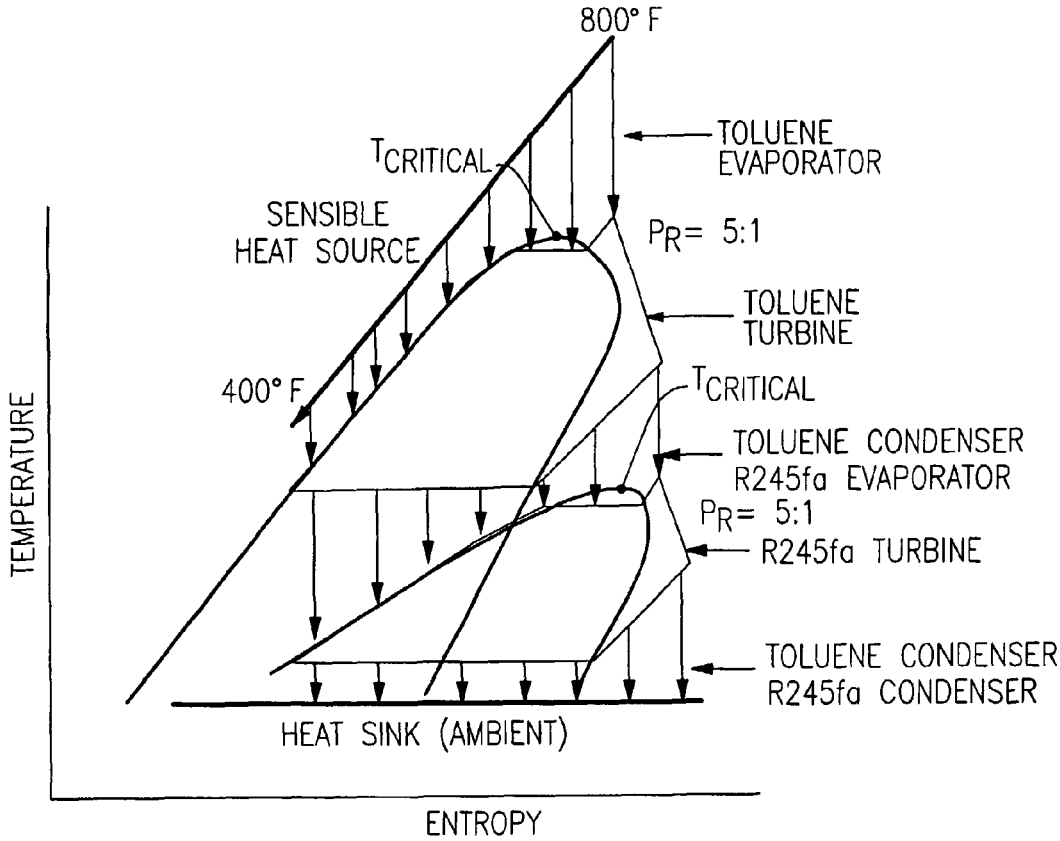
FIG. 4 is a TS diagram thereof.

Typically an unrecuperated microturbine has an exit temperature of its exhaust gases of about 1200° F. This hot gas can be used to boil a high temperature organic fluid such as pentane, toluene or acetone in an ORC. If toluene is the working fluid, the leaving temperature from the vapor generator 17 would be about 500° F., and the temperature of the vapor leaving the turbine 19 and entering the condenser 23 would be about 300° F. After being condensed, the liquid toluene is at a temperature of about 275° F. as it leaves the condenser 23 and passes to the vapor generator 17 by way of the pump 24. These temperatures and related entropies are shown in the TS diagram of FIG. 4.

In this cascaded ORC arrangement, the first ORC system (i.e. the toluene loop), is a high temperature system that extracts all the heat, either sensible such as from a hot gas or hot liquid, or latent such as from a condensing fluid such as steam in a refrigerant boiler/evaporator, creating high pressure and high temperature vapor. This high pressure vapor expands through the turbine 19 to a lower pressure with a saturation temperature corresponding to a level where a low cost/low temperature ORC system can be used to efficiently and cost effectively convert the lower temperature waste heat to power. By doing this, the high temperature refrigerant still has positive pressure and a corresponding larger density in the condenser 23. This results in a condenser with less pressure drop, better heat transfer and smaller size, all of which result in a more cost effective ORC system. The high pressure and larger density of the vapor exiting the turbine 19 also allows a smaller turbine design. A substantial reduction in cost can be obtained by these modifications. Further, the lower pressure ratio (i.e. 5:1) at the turbine 19 allows for higher turbine efficiencies.

Considering now that the temperature of the toluene vapor entering the condenser/evaporator 23 is relatively high, its energy can now be used as a heat source for a vapor generator of a second ORC system 25, with the condenser/evaporator 23 acting both as the condenser for the first ORC system 20 and as the evaporator or boiler of the second ORC 25 system. The second ORC system therefore has a turbine 26, a generator 27, a condenser 28 and a pump 29. The organic working fluid for the second ORC must have relatively low boiling and condensation temperatures. Examples of organic working fluids that would be suitable for such a cycle are R245fa or isobutane.

In the second ORC system 25, with R245fa as the organic working fluid, the temperature of the working fluid passing to the turbine 26 would be around 250° F., and that of the vapor passing to the condenser would be about 90° F. After condensation of the vapor, the refrigerant would be pumped to the condenser/evaporator 23 by the pump 29.

Figure 5:
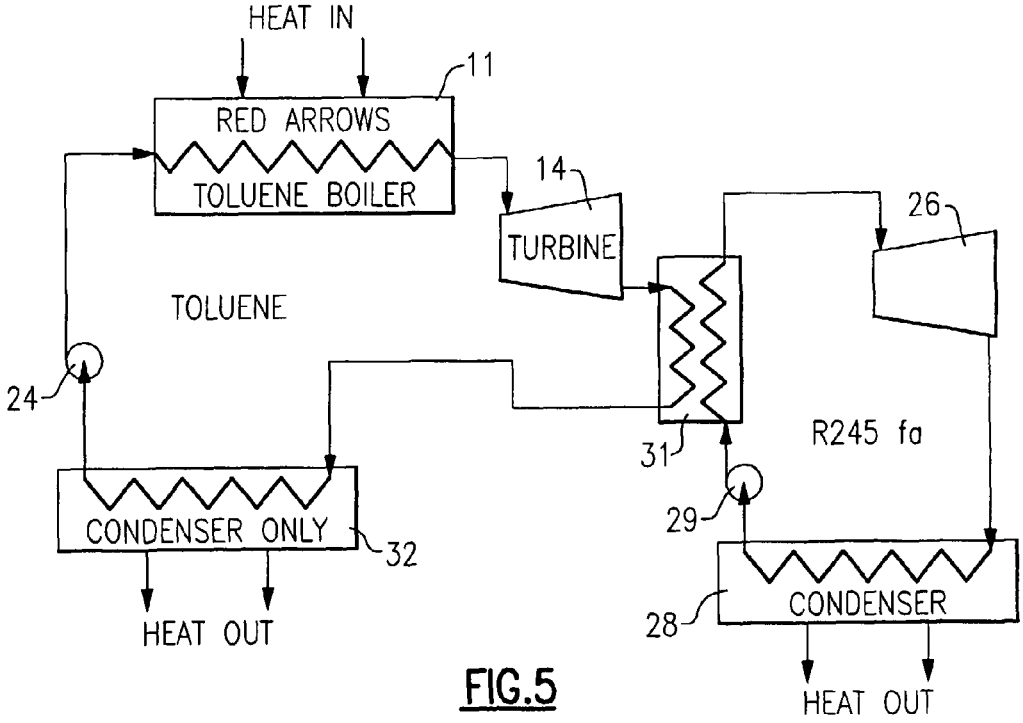
FIG. 5 is an alternate embodiment of the present invention.
Figure 6:
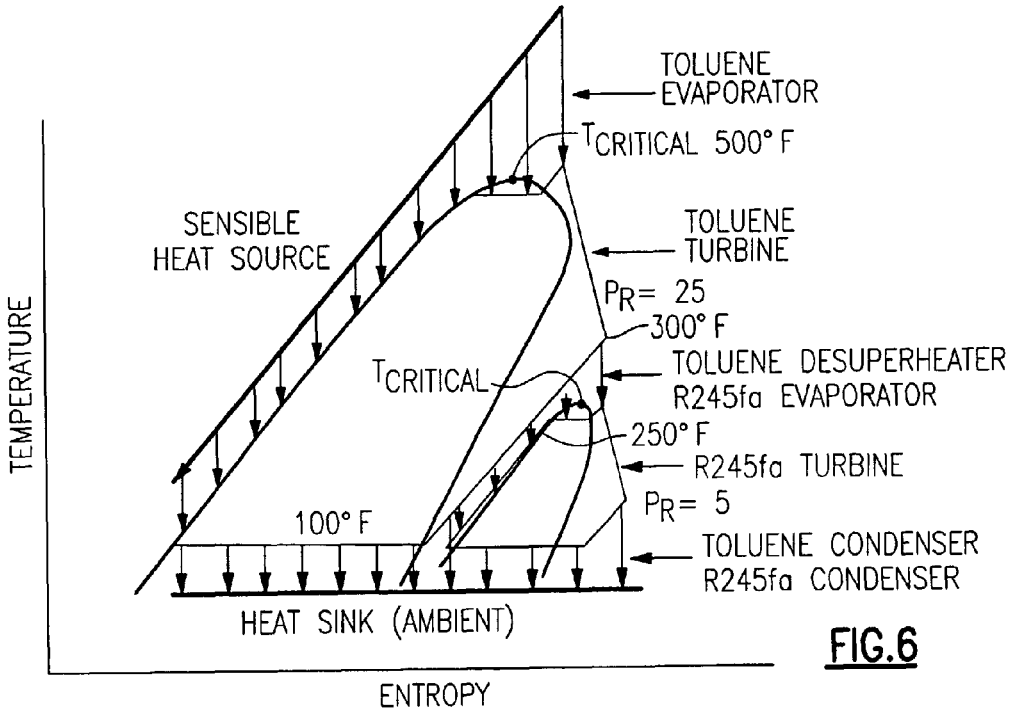
FIG. 6 is a TS diagram thereof.

Referring to FIG. 5, an alternate, nested arrangement is shown wherein, within the toluene circuit, the working fluid again passes from the boiler or vapor generator 17 to the turbine and then to a common heat exchanger 31. Again, the heat exchanger 31 acts as an evaporator or boiler for the R245fa circuit, with the R245fa refrigerant passing from the boiler 31 to the turbine 26 to a condenser 28, the pump 29, and back to the boiler 31. However, unlike the condenser/evaporator 23 of the FIG. 3 embodiment, the heat exchanger 31 acts as a desuperheater only within the toluene circuit, with a condenser 32 then being applied to complete the condensation process before the working fluid is passed by way of the pump 24 back to the boiler 17. The TS diagram for such a nested ORC cycle system is shown in FIG. 6.

In this nested arrangement a cost reduction is obtained by adding the low temperature, R245fa, ORC system in such a way that the overall system efficiency is increased. The major irreversibility (thermodynamic loss) of the simple cycle high temperature ORC system is the so-called desuperheat loss in the condenser. Organic fluids leave the turbine more superheated than they enter it. The larger the pressure ratio at the turbine, the stronger this effect. High temperature simple cycle ORC systems, although thermodynamically more efficient than the simple cycle low temperature ORC systems, reject a lot of moderate temperature waste heat that has to be rejected in the desuperheater/condenser. As a result, a relatively large condenser is required. In the nested ORC system, desuperheating is done in the low temperature ORC evaporator 31. This increases the overall power output since this heat was previously rejected to ambient and is now used in a low temperature ORC system to generate power. A further advantage is that the size of the high temperature ORC condenser 32 may be reduced.

Thus, the overall result of the nested ORC system is a more cost effective overall ORC system for high temperature waste heat sources. The increased cost effectiveness is obtained by increased power output and by reducing the size of the original desuperheater/condenser unit.

Although the FIG. 5 embodiment has been described in terms of use with two different refrigerants, it should be understood that the same refrigerant could be used in the two circuits.

Figure 8:
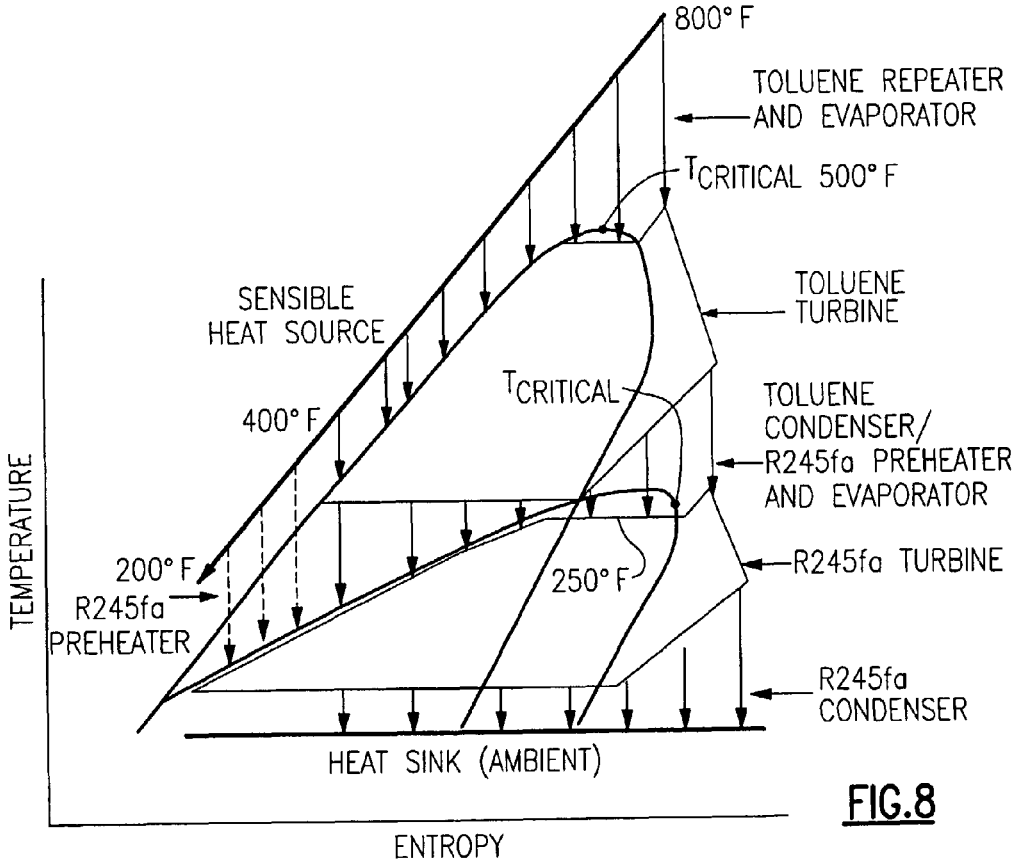
FIG. 8 is a TS diagram thereof.
Figure 7:
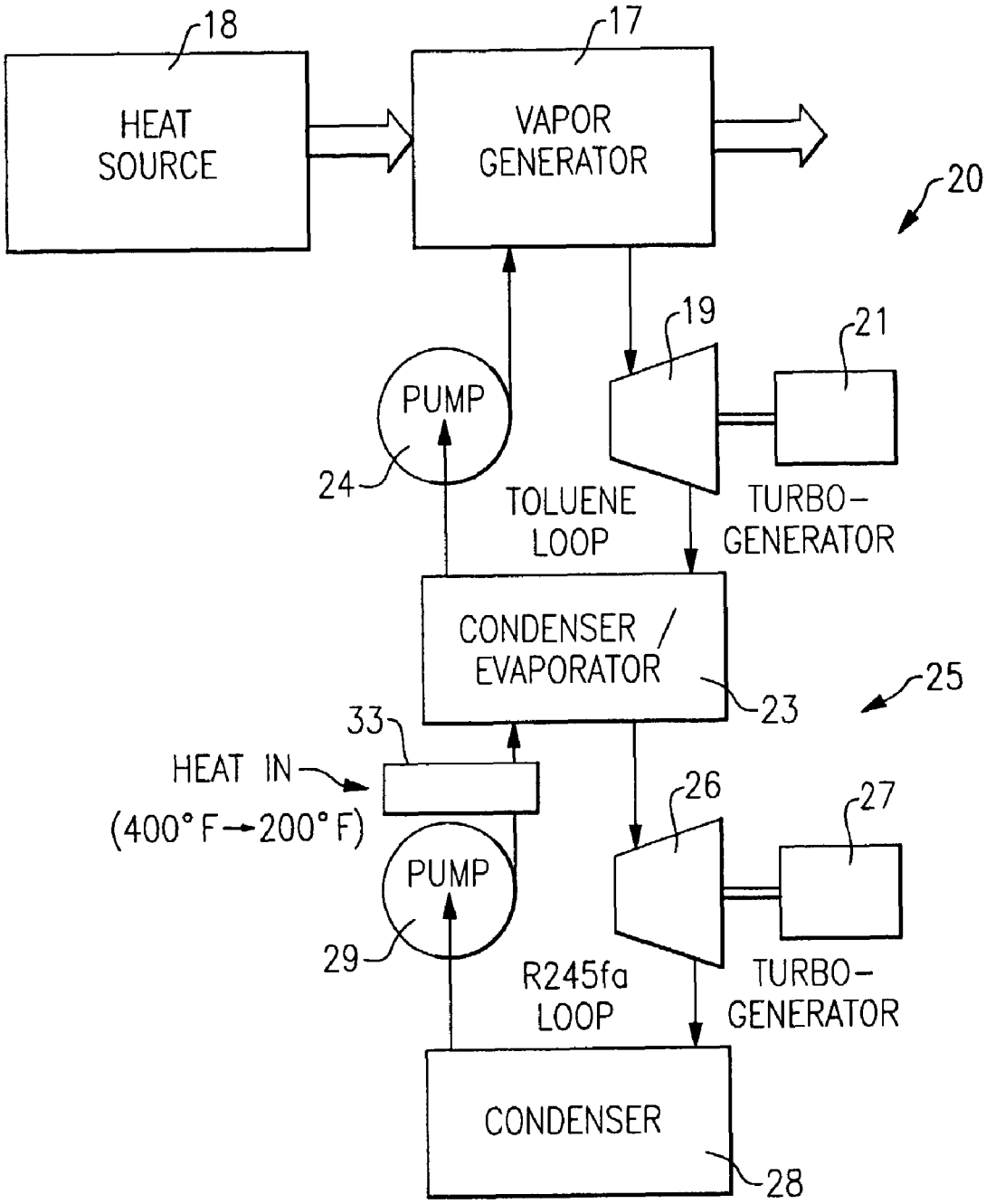
FIG. 7 is another alternate embodiment of the present invention.

A further embodiment of the present invention is shown in FIG. 7 wherein the FIG. 5 embodiment is modified by the addition of a preheater 33 in the R245fa cycle as shown. Here, the working fluid, after passing through the condenser 28 and the pump 29, passes through the liquid preheater 33 using the waste heat source at lower temperatures (from 400° F. to 200° F.). The corresponding TS diagram is shown in FIG. 8.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A method of generating additional energy with an organic Rankine cycle system having in serial flow relationship a turbo generator for receiving a first organic fluid from a vapor generator, a heat exchanger, and a first pump for returning refrigerant to the vapor generator, comprising the steps of:

providing a second organic Rankine cycle system having in serial flow relationship a second turbo generator for receiving a second organic working fluid from said heat exchanger, a first condenser, and a second pump for returning said second organic working fluid to said heat exchanger, wherein said first and second organic working fluids flow in heat exchange relationship through said heat exchanger, and wherein said first organic working fluid is toluene and said second organic working fluid is R245fa.

2. A method as set forth in claim 1 and including the step of desuperheating and condensing the first organic fluid in said heat exchanger.

3. A method as set forth in claim 1 and including the step of providing a second condenser between said heat exchanger and said first pump.

4. A method as set forth in claim 3 and including the steps of desuperheating said first organic fluid in said heat exchanger and condensing said first organic fluid in second condenser.

5. A method as set forth in claim 1 and including the step of providing a preheater between said second pump and said heat exchanger.

6. A combination of organic Rankine cycle systems comprising:

a first organic Rankine cycle system having in serial flow relationship a first turbo generator for receiving a first organic working fluid from a vapor generator, a heat exchanger and a first pump returning said first organic working fluid to the vapor generator; and a second organic Rankine cycle system having in serial flow relationship a second turbo generator for receiving a second organic working fluid from said heat exchanger, a first condenser, and a second pump for returning said second organic working fluid to said heat exchanger, wherein said first and second organic working fluids are circulated in heat exchange relationship within said heat exchanger, and wherein said first organic working fluid is toluene and said second organic working fluid is R245fa.

7. A combination as set forth in claim 6 wherein said heat exchanger is operated to both desuperheat and condense said first organic working fluid.

8. A combination as set forth in claim 6 and including a second condenser between said heat exchanger and said first pump.

9. A combination as set forth in claim 8 wherein said heat exchanger is applied to only desuperheat said first organic working fluid and said second condenser is applied to condense said first organic working fluid.

10. A combination as set forth in claim 6 and including a preheater between said second pump and said heat exchanger.

11. A system for converting waste heat into energy comprising:

a first organic Rankine cycle system having in serial flow relationship a vapor generator which is in heat exchange relationship with said waste heat, a first turbo generator for receiving a first organic working fluid from said vapor generator, a heat exchanger, a first condenser, and a first pump for returning said first organic working fluid to said vapor generator; and a second organic Rankine cycle system having in serial flow relationship a second turbo generator for receiving a second organic working fluid from said heat exchanger, a second condenser, and a second pump for returning said second organic working fluid to said heat exchanger, wherein said first organic working fluid passes to said heat exchanger at a first temperature and further wherein said temperature is substantially above a boiling temperature of said second organic working fluid.

12. A system as set forth in claim 11 wherein said first organic working fluid is toluene.

13. A system as set forth in claim 11 wherein said second organic working fluid is R245fa.

14. A system as set forth in claim 11 wherein said heat exchanger is applied to only desuperheat said first organic working fluid and said first condenser is applied to condense said first organic working fluid.

15. A system as set forth in claim 11 and including a preheater between said second pump and said heat exchanger.

* * * * *